US005531625A

United States Patent [19]

Zhong

[11] Patent Number: 5,531,625

[45] Date of Patent: Jul. 2, 1996

[54] UNIVERSAL JOINT DEVICE FOR A TOY

[76] Inventor: Chun-Chium Zhong, 58, Ma Yuan West St., Taichung, Taiwan

[21] Appl. No.: 443,732

[22] Filed: May 18, 1995

[51] Int. Cl.[6] ..... A63H 33/08

[52] U.S. Cl. ..... 446/120; 403/113; 403/165; 59/80

[58] Field of Search ..... 446/120, 121, 446/376, 383, 97, 99; 403/142, 164, 165, 113, 311; 59/80, 2, 900

[56] References Cited

U.S. PATENT DOCUMENTS 2,021,115 11/1935 Jackson ..... 446/383

2,714,269 8/1955 Charles ..... 446/121 X 4,037,978 7/1977 Connelly ..... 403/164

*Primary Examiner*—Mickey Yu

[57] ABSTRACT

A universal joint device includes a number of couplers. Each coupler has a spherical head and a frustum portion secured together for engaging with the frustum portion and the spherical head of the other couplers. A tube has a frustum portion formed on one end for engaging with the spherical head of the couplers and has an annular rib extended radially inward from the other end. A rod has a number of teeth for engaging with the annular rib so as to secure the rod to the tube. The rod has a spherical head formed on one end for engaging with the frustum portion of the couplers.

1 Claim, 3 Drawing Sheets

UNIVERSAL JOINT DEVICE FOR A TOY

BACKGROUND OF THE INVENTION

1. Field of the Invention

The present invention relates to a joint device, and more particularly to a universal joint device for a toy.

2. Description of the Prior Art

Typical toys comprise a body and a number of limbs pivotally coupled to the body. However, the limbs of the typical toys are coupled to the body by pivot axles or pivot shafts such that the limbs may not be rotated freely relative to the body.

The present invention has arisen to mitigate and/or obviate the afore-described disadvantages of the conventional toys.

SUMMARY OF THE INVENTION

The primary objective of the present invention is to provide a universal joint device for pivotally coupling the limbs to the body such that the limbs may be moved freely.

In accordance with one aspect of the invention, there is provided a universal joint device comprising at least one coupler including a first spherical head and a first frustum portion having a neck portion formed between the first spherical head and the first frustum portion, the first spherical head including a tip, a tube including a first end having a second frustum portion formed therein for engaging with the first spherical head of the coupler, and including a second end having an annular rib extended radially inward therefrom, and a rod including a first end engaged in the tube and including a plurality of teeth for engaging with the annular rib so as to secure the rod to the tube, the rod including a second end having a second spherical head formed thereon for engaging with the first frustum portion of the coupler. The first spherical head of the coupler includes a tip for engaging with the second frustum portion so as to limit a rotational movement of the first spherical head relative to the second frustum portion.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
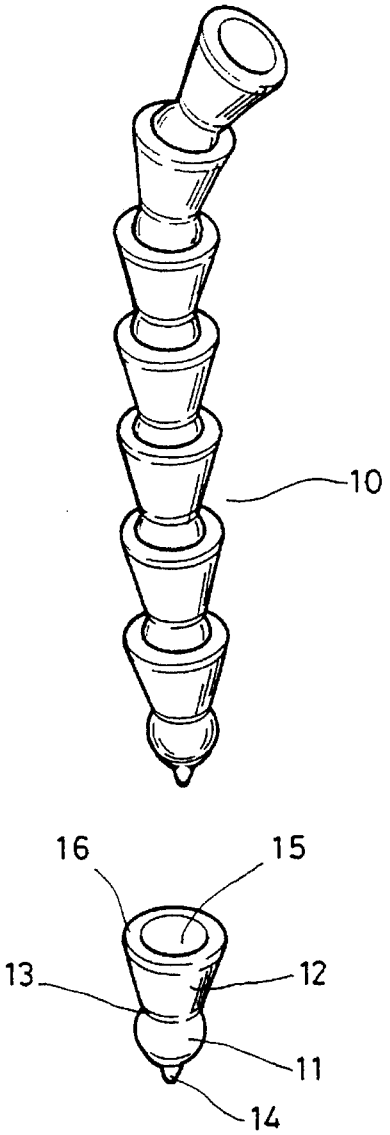
FIG. 1 is a partial exploded view of a universal joint device for a toy in accordance with the present invention.
Figure 2:
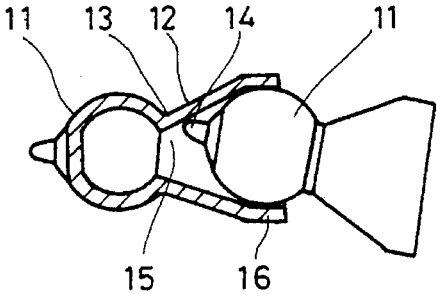
FIG. 2 is a cross sectional view of the universal joint device.

Referring to the drawings, and initially to FIGS. 1 and 2, a universal joint device in accordance with the present invention comprises a number of couplers 10. Each coupler

10 which includes a spherical head 11 and a frustum portion 12 has a neck portion 13 provided between the spherical head 11 and the frustum portion 12. The frustum portion 12 includes a hollow interior 15 for engaging with the spherical head 11 and includes an annular flange 16 engaged with the spherical head 11 so as to retain the spherical head 11 in place, such that the spherical head 11 is freely rotatable in the frustum portion 12. The spherical head 11 includes a tip 14 distal to the frustum portion 12 for engaging with the inner surface of the frustum portion 12 so as to limit the rotational movement of the spherical head 11 relative to the frustum portion of the other coupler 10.

Figure 3:
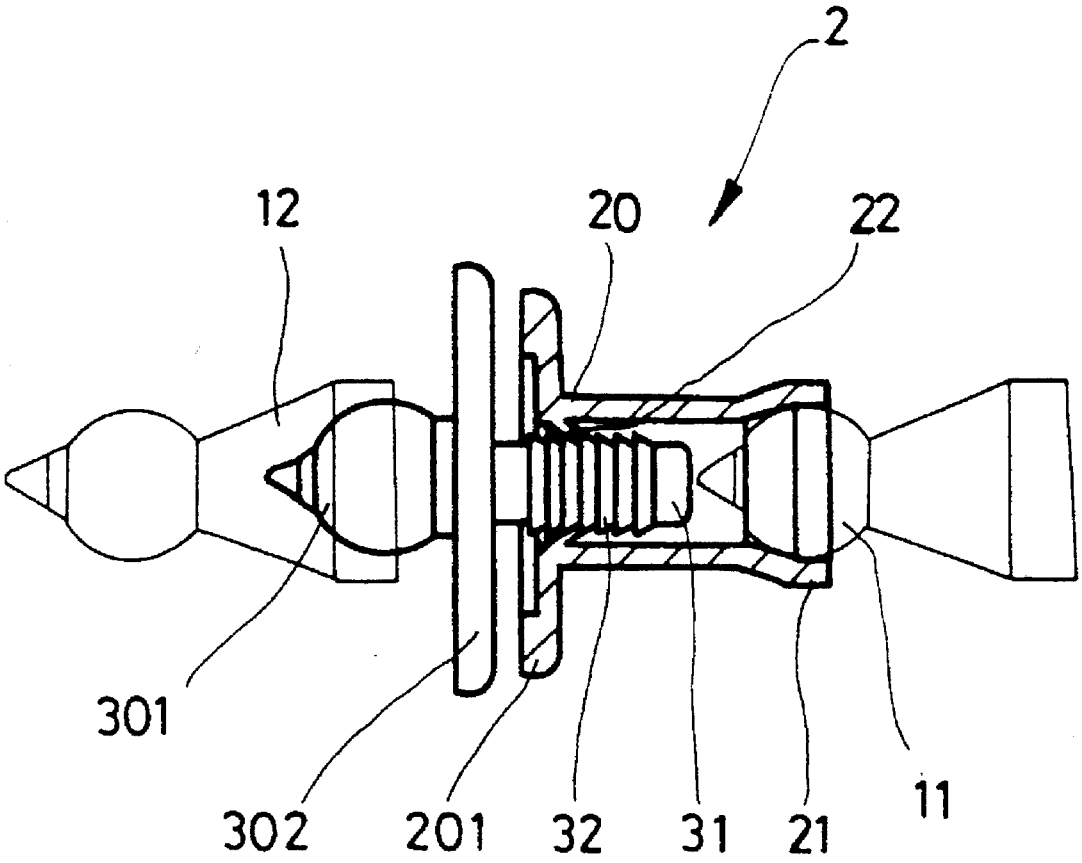
FIG. 3 is a cross sectional view illustrating a coupling member of the universal joint device.
Figure 4:
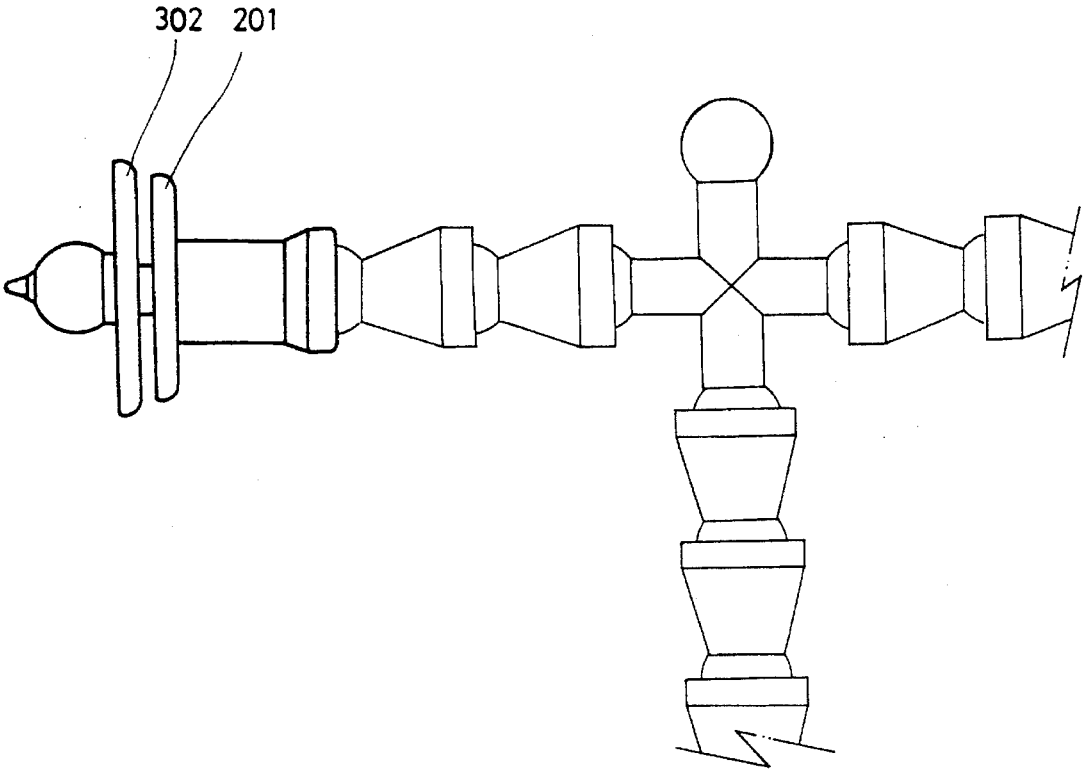
FIG. 4 is a plane view illustrating the application of the universal joint device.

Referring next to FIGS. 3 and 4, a number of coupling members 2 are further provided for coupling the couplers 10 together. Each of the coupling members 2 includes a tube 20 having an annular flange 201 formed on one end and having an annular rib 22 extended radially inward from the one end for engaging with a number of teeth 32 formed on a rod 31. The rod 31 includes a disc 302 formed on one end and a spherical head 301 formed thereon for engaging with the frustum portion 12 of the couplers 10. The tube 20 also includes a frustum portion 21 for engaging with the spherical heads 11 of the couplers 10. The annular rib 22 may be engaged with either of the teeth 32 so as to adjust the relative position of the rod 31 relative to the tube 20.

Accordingly, the universal joint device in accordance with the present invention may be provided for forming the limbs of the toys and may be provided for freely coupling the limbs to the body of the toys.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A universal joint device comprising:

at least one coupler including a first spherical head and a first frustum portion having a neck portion formed between said first spherical head and said first frustum portion, a tube including a first end having a second frustum portion formed therein for engaging with said first spherical head of said coupler, and including a second end having an annular rib extended radially inward therefrom, a rod including a first end adapted to be engaged in said tube and including a plurality of teeth for engaging with said annular rib so as to secure said rod to said tube, said rod including a second end having a second spherical head formed thereon for engaging with said first frustum portion of said coupler, and said first spherical head of said coupler including a tip for engaging with said second frustum portion so as to limit a rotational movement of said first spherical head relative to said second frustum portion.

* * * * *